US006324727B1

(12) United States Patent
Ortoleva et al.

(10) Patent No.: US 6,324,727 B1
(45) Date of Patent: Dec. 4, 2001

(54) TRACK SPACER FOR TWIN SLIDING DOOR INSTALLATIONS

(75) Inventors: Joseph Ortoleva, Guilford; Thomas Pelletier, Wallingford, both of CT (US); Susanna Perrett, University Heights, OH (US)

(73) Assignee: The Stanley Works, New Britain, CT (US)

( * ) Notice: Subject to any disclaimer, the term of this patent is extended or adjusted under 35 U.S.C. 154(b) by 0 days.

(21) Appl. No.: 09/482,728

(22) Filed: Jan. 14, 2000

Related U.S. Application Data

(60) Provisional application No. 60/157,019, filed on Oct. 1, 1999.

(51) Int. Cl.[7] ..... E05D 13/00

(52) U.S. Cl. ..... 16/94 R; 16/87.4 R; 49/409; 248/231.81

(58) Field of Search ..... 16/94 R, 87.4 R, 16/95 R, 96 R, 87 B, 101; 49/409, 425; 248/228.7, 231.81; 104/89, 139; 105/148; 238/29

(56) References Cited

U.S. PATENT DOCUMENTS

| | | | | |
|---|---|---|---|---|
| 1,422,473 | * | 7/1922 | Phillips | 49/425 |
| 2,686,960 | * | 8/1954 | Roy | 248/231.81 |
| 2,796,626 | * | 6/1957 | Gussack | 16/101 |
| 2,865,043 | | 12/1958 | Cox . | |
| 3,131,447 | * | 5/1964 | Tinnerman | 248/228.7 |
| 3,201,874 | | 8/1965 | Christy . | |
| 3,458,184 | | 7/1969 | Schlosser . | |
| 3,494,042 | | 2/1970 | Engholm . | |
| 4,333,286 | * | 6/1982 | Weinar | 52/281 |
| 5,031,886 | | 7/1991 | Sosebee . | |
| 5,148,605 | * | 9/1992 | Julia | 269/43 |
| 5,379,553 | | 1/1995 | Kimura et al. . | |
| 5,407,182 | | 4/1995 | Hartley . | |
| 5,490,334 | | 2/1996 | Payne . | |
| 5,628,119 | | 5/1997 | Bingham et al. . | |
| 5,785,306 | * | 7/1998 | Wilson et al. | 269/41 |
| 5,913,546 | | 6/1999 | Kuchenbrod et al. . | |

FOREIGN PATENT DOCUMENTS

| | | | | |
|---|---|---|---|---|
| 0487956A1 | * | 6/1992 | (IT) | 16/94 R |
| 2220966 | * | 6/1992 | (GB) | 16/87.4 R |

* cited by examiner

*Primary Examiner*—Anthony Knight
*Assistant Examiner*—Mark Williams
(74) *Attorney, Agent, or Firm*—Pillsbury Winthrop LLP

(57) ABSTRACT

A system for installing a pair of separate door guiding tracks in a predetermined parallel relation below and to an overhead structure of a door opening comprising applying a series of track spacing members to a pair of separate tracks while the tracks are disposed in predetermined parallel relation at longitudinally spaced positions along the tracks so as to retain the tracks in predetermined parallel relation, fixedly securing the tracks while retained in predetermined parallel relation by a series of spacing members below and to the overhead structure of the door opening, and moving each track spacing member downwardly with respect to the pair of tracks after installation to remove the series of track spacing members from the tracks.

15 Claims, 4 Drawing Sheets

TRACK SPACER FOR TWIN SLIDING DOOR INSTALLATIONS

This application claims benefit of Prov. No. 60/157,019 Oct. 1, 1999.

This invention relates to dual or twin sliding door assemblies and more particularly to the installation of such assemblies.

BACKGROUND OF THE INVENTION

Door assemblies of the type herein contemplated typically include a one-piece track structure which includes a pair of parallel tracks integrally interconnected by a bridge section. This one-piece construction insures that, when the assembly is finally installed, the two doors will by-pass one another in parallel relationship. It is important in the installation of the assembly to precisely establish the parallel relationship between the two tracks.

It is often the practice of door assembly suppliers to supply a wide range of door assemblies including pocket door and bi-fold installations. In these installations, a single track is utilized. It is also desirable to provide a carriage assembly for all of the installations which will cooperate with the same track configuration.

It is desirable not to have to inventory two separate track profiles for both the dual sliding installation and the pocket/bi-fold installations.

Applicant has found that it becomes a practical matter to reduce the inventories to a single track structure provided some system is provided to the installer to simplify and insure accurate installation of two separate tracks in exact parallel relation to one another.

BRIEF DESCRIPTION OF THE PRESENT INVENTION

An object of the present invention is to solve the inventory problem expressed above. In accordance with the principles of the present invention, this objective is obtained by providing a system for installing a pair of separate door guiding tracks in a predetermined parallel relation below and to an overhead structure of a door opening comprising applying a series of track spacing members to a pair of separate tracks while the tracks are disposed in predetermined parallel relation at longitudinally spaced positions along the tracks so as to retain the tracks in said predetermined parallel relation, fixedly securing the tracks while retained in predetermined parallel relation by the series of spacing members below and to the overhead structure of the door opening, and moving each track spacing member downwardly with respect to said pair of tracks after installation to remove the series of track spacing members from the tracks.

Another object of the present invention is to provide an apparatus for use in installing a pair of elongated tracks in fixedly mounted parallel relation below overhead structure of a door opening, each of the tracks including a central wall constructed and arranged when installed to extend horizontally in fixed relation below the overhead structure of the door opening, a pair of end walls constructed and arranged when installed to extend vertically downwardly from opposite end edges of the central wall, and elongated laterally spaced wheel supporting walls constructed and arranged when installed to extend inwardly toward one another from lower edges of the end walls in vertically spaced relation below the central wall. The apparatus comprises a series of track spacing members constructed and arranged to be removably attached to the pair of tracks in longitudinally spaced relation in operative positions so as to retain the pair of tracks in a predetermined spaced parallel relation with respect to one another during installation. Each of the track spacing members includes structure constructed and arranged to be engaged between the spaced end walls of the pair of tracks when the spacing member is in the operative position and structure constructed and arranged to be disposed between the end walls of each track in engaged relation between the wheel supporting walls thereof when the spacing member is in the operative position. The structure of each of the track spacing members further is constructed and arranged to enable the track spacing member to be moved into the operative position with respect to the pair of tracks in a direction toward the center walls thereof and to be removed from the operative position with respect to the tracks by a downward movement in a direction away from the central walls thereof after installation.

Figure 1:
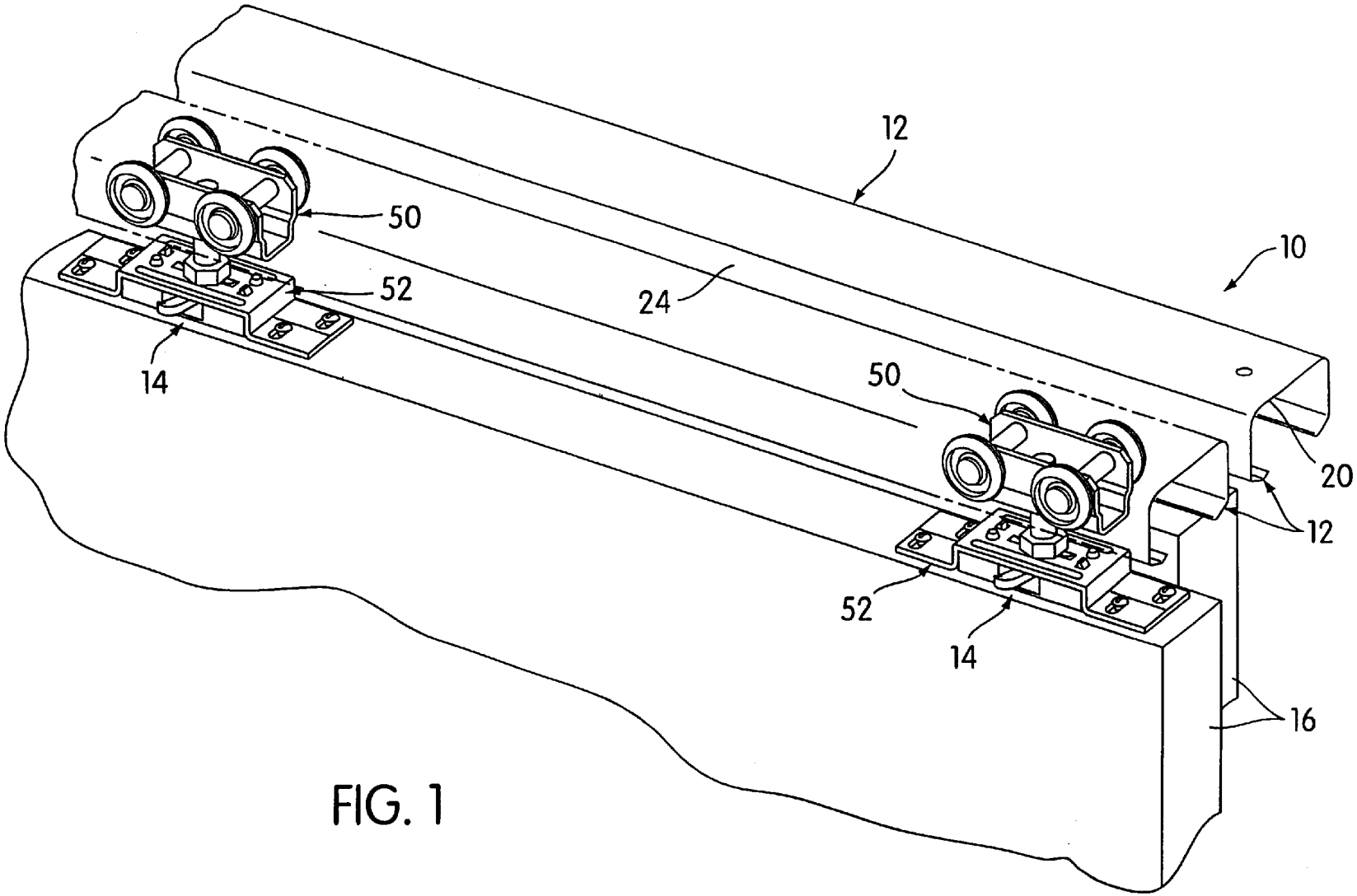
FIG. 1 is a fragmentary perspective view looking down from the top on one side of a twin sliding door assembly embodying the principles of the present invention.

Referring now more particularly to the drawings, there is shown in FIG. 1 thereof a twin sliding door installation, generally indicated at 10, embodying the principles of the present invention. The installation 10 includes a pair of tracks, generally indicated at 12, constructed and arranged to be fixedly mounted in parallel relation to the overhead structure (not shown) defining the door opening of the installation 10. Mounted within each of the tracks 12 is a pair of movable door mounting assemblies, generally indicated at 14. Each pair of assemblies 14 serves to mount a door panel 16 for movement along the associated track 12 between the sides of the structure (not shown) defining the door opening. Suitable structure (not shown) may be provided along the floor structure defining the door opening to guide the lower edges of the door panels during their sliding movement as is well known in the art.

Figure 2:
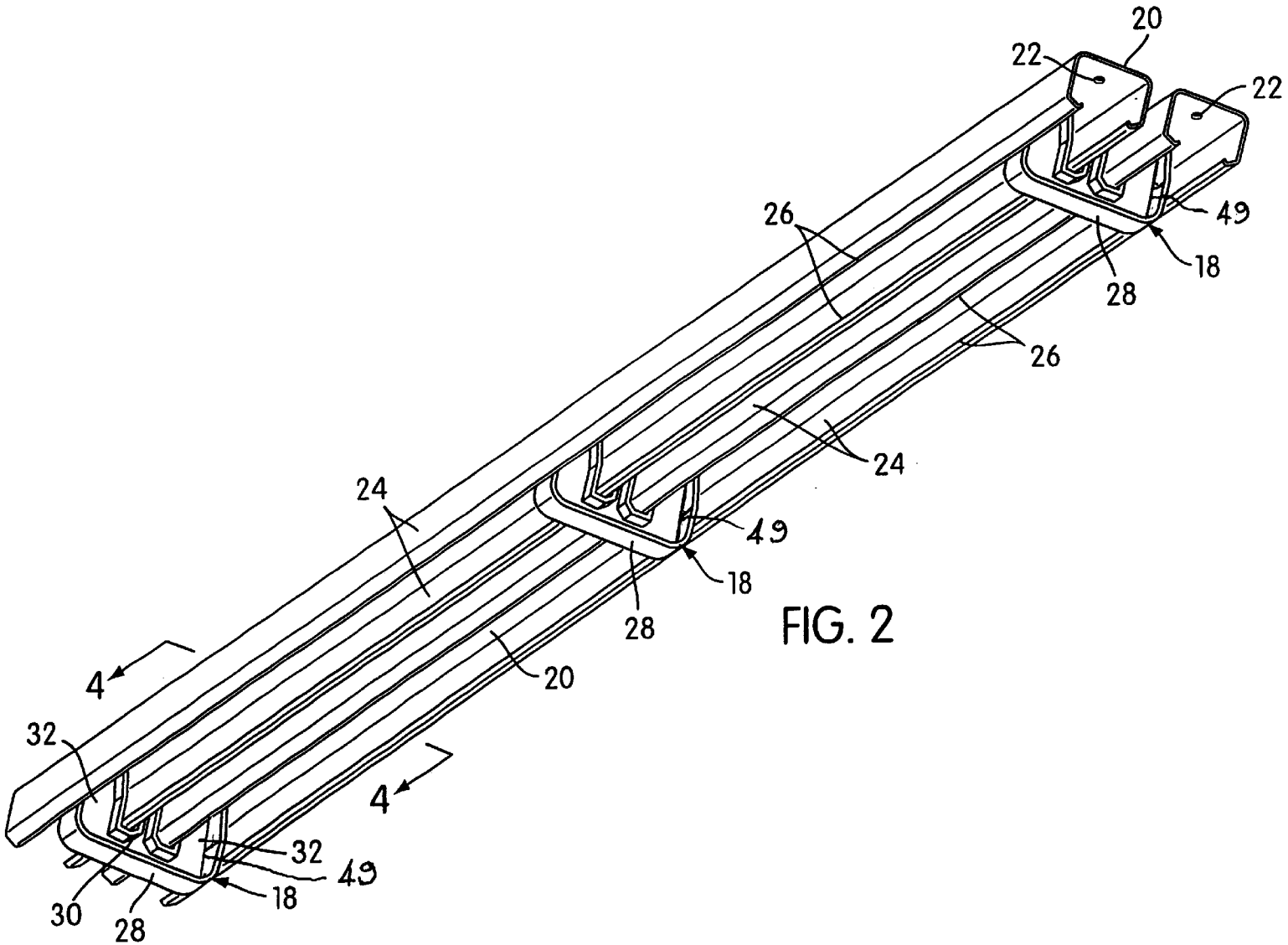
FIG. 2 is a perspective view of the spaced tracks of the installation shown in FIG. 1 with a series of longitudinally spaced removable spacing members removably mounted in an operative position therewith during the installation of the tracks.

FIG. 2 illustrates the combination of the pair of tracks 12 held in a predetermined parallel relation by a series of track spacing members, generally indicated at 18, each of which, in accordance with the principles of the present invention, is constructed and arranged to be removably mounted within and between the pair of tracks 12 so as to retain the same in a predetermined parallel relationship during the installation thereof. Each of the track spacing members 18 is constructed and arranged to enable the track spacing member 18 to be moved into an operative position with respect to the pair of tracks 12, as shown in FIG. 2, in a direction to enter within and between the tracks 12 and to be removed from the operative position with respect to the tracks 12 by movement in the opposite direction, as shown in FIG. 3.

Figure 3:
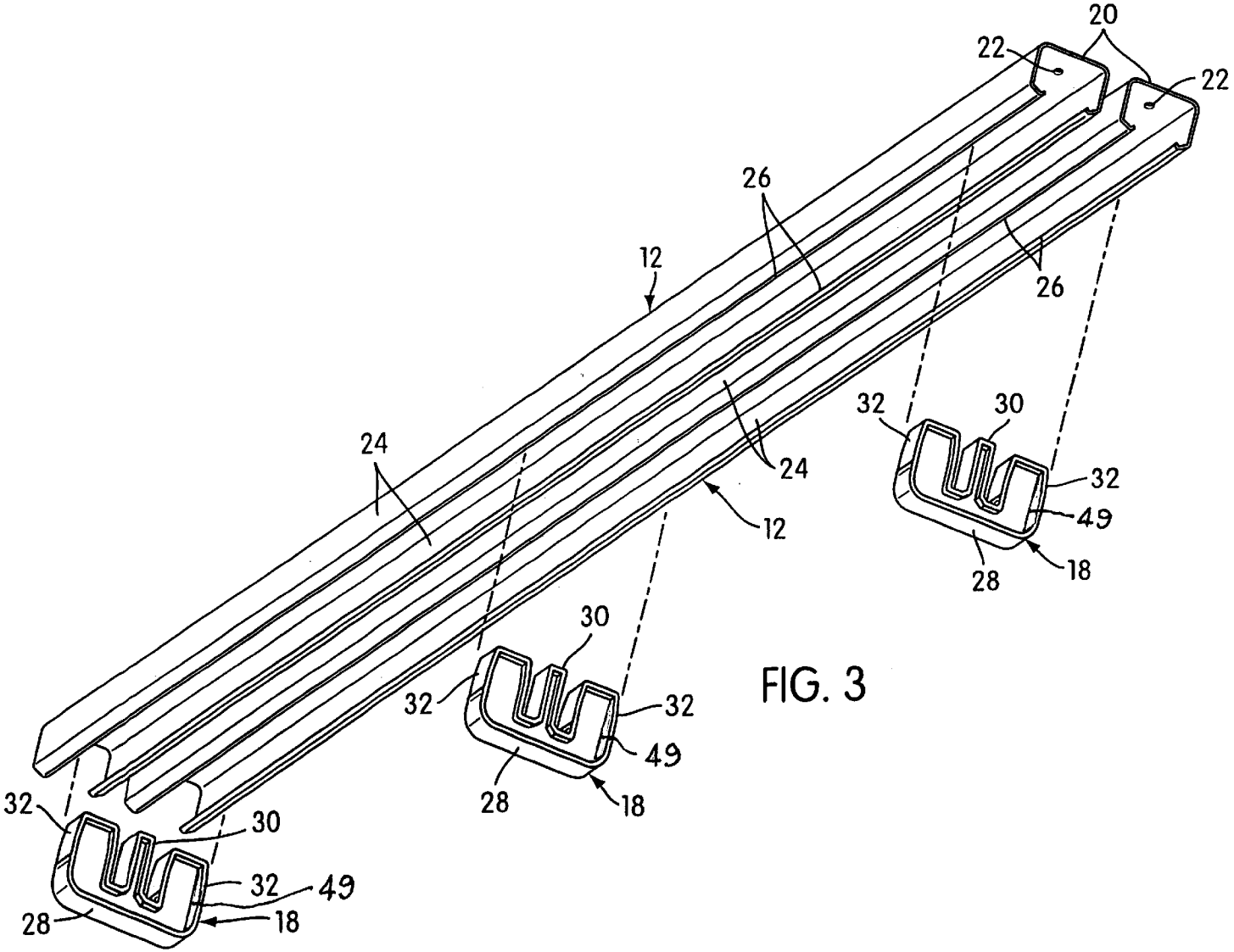
FIG. 3 is a view similar to FIG. 2 showing the spacing members removed from the tracks after they have been installed.
Figure 4:
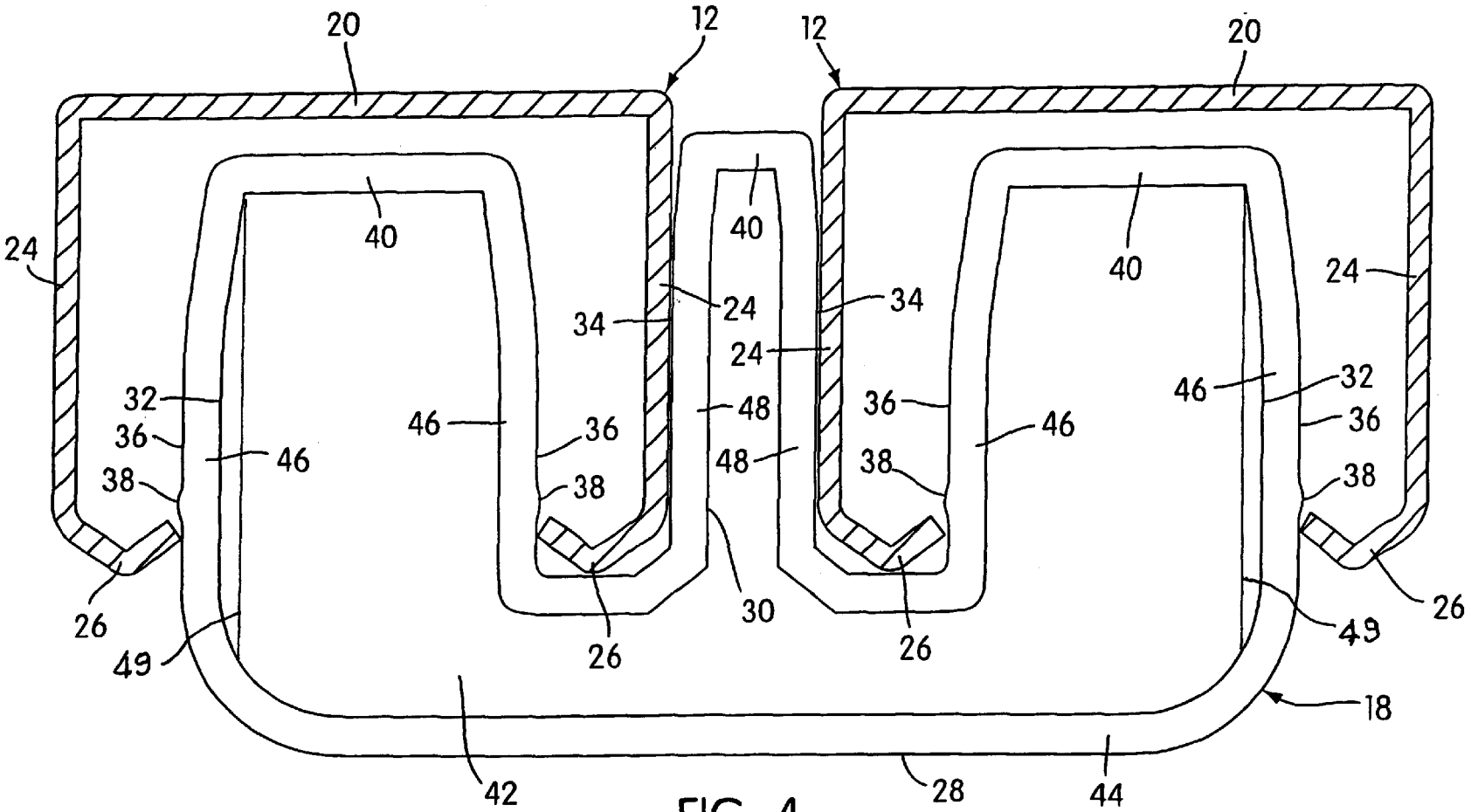
FIG. 4 is an enlarged sectional view taken along the line 4—4 of FIG. 2.

As best shown in FIGS. 2–4, each track 12 includes an elongated central wall 20 which is constructed and arranged to be fixedly mounted beneath the overhead structure defining the door opening. The central wall 20 of each track 12 can be fixedly mounted beneath the overhead structure by any suitable means as, for example, a series of longitudinally spaced screws 22 or the like.

Each track 12 also includes a pair of elongated end walls 24 constructed and arranged when installed to extend downwardly from opposite edges of the central wall 20. Each track 12 also includes a pair of wheel engaging walls or flanges 26 constructed and arranged when installed to extend inwardly toward one another from the lower edges of the end walls 24.

While the track spacing members 18 may be of any suitable construction, the preferred construction shown in the drawings is in the form of a molded plastic body made from a suitable plastic material as, for example, polypropylene. Each of the track spacing members 18 defined by the molded plastic body includes an outer transversely extending portion 28, a central track end wall engaging portion 30 extending from the outer portion 28 and track entering portions 32 extending from the outer portion 28 in spaced relation on opposite sides of the central track end wall engaging portion 30. Each central end wall engaging portion 30 includes opposed surfaces 34 configured and positioned to enter between the tracks 12 and engage adjacent end walls 24 of the tracks 12 when the track spacing member 18 is in the operative position thereof. Each track entering portion 32 includes surfaces 36 configured and positioned to engage the inner edges of the wheel supporting walls 26 of the associated track 12 when the track spacing member 18 is in the operative position thereof.

Each surface 36 of each track entering portions 32 includes a slight projection 38 over which the inner edges of the walls 26 snap during the movement of the track spacing member 18 into the operative position thereof and which releasably retain the track spacing member 18 in the operative position thereof. The track entering portions 32 and central portion 30 each include a free end section 40 which tapers inwardly toward a free end thereof to facilitate entry within and between the tracks 12.

In the preferred embodiment shown, the molded plastic body is formed of peripheral walls of generally uniform thickness integrally interconnected by a central reinforcing wall 42. The peripheral walls include an outer peripheral wall 44 defining the outer transversely extending portion 28, a pair of generally U-shaped walls 46 defining the track entering portions 32, each having one end connected to an end of the outer wall 44 and a central U-shaped wall 48 defining the central portion 30 having opposite ends connected to ends of the pair of U-shaped walls 46.

As shown, the periphery of the central reinforcing wall 42 is integral with the central interior surfaces of all of the peripheral walls 44, 46 and 48 except for a pair of oppositely facing generally parallel free edges 49 disposed in closely spaced relation to the outer leg portions of the pair of U-shaped peripheral walls 46. This spaced free edge relationship renders the outer leg portions much more resiliently flexible than the bight portions and inner leg portions of the pair of U-shaped peripheral walls 46. The central reinforcing wall 42 is integrally interconnected with the center of the entire interior surface of the central U-shaped wall 48 and hence the central portion 30 defined thereby is relatively stiff and unyielding so as to provide the spacing between the two tracks 12. The resiliency provided at the outer leg portions of the pair of U-shaped walls 46 accommodate tolerance variations in the tracks 12.

As is indicated in FIGS. 2 and 3, each of the track spacing members 18 is mounted in fixed relation with respect to the two tracks 12 by moving each track spacing member 18 in a direction toward the central wall 20 of the track 12 at a desired position therealong. As each track spacing member 18 is moved inwardly within the two tracks 12, the bumps 38 within the surfaces move past the track flanges and the resulting snap action tells the installer that the spacing member has been moved into its operative position. The engagement of the projections 38 beyond the flanges 26 serves to retain the spacing member 18 in its operative relation with respect to the tracks 12.

An alternative to mounting the series of track spacing members 18 with respect to the two tracks 12 is to mount them in a first track 12 and position and fixedly secure the second track 12 separately directly into its position below and to the overhead structure of the door opening. Thereafter, the first track 12 with the track spacing members 18 mounted therein is moved alongside the first so that the track spacing members 18 also enter the second track 12 to thereby hold the first track 12 in proper relation to the already fixed second track 12. A less desirable alternative, also contemplated, would be to mount the track spacing members 18 on both the second track already separately fixedly secured, as aforesaid, and a first track 12 held in position alongside the second.

The number of spacing members 18 included in the series will depend upon the length of the tracks 12. On occasion, there may be a requirement to mount more than two tracks 12 in parallel relation and, in these instances, a series of spacing members 18 can be mounted with respect to each pair of adjacent tracks 12 to effect the predetermined parallel spaced relationship. Once the spacing members 18 have been mounted within the tracks 12, the tracks 12 are moved upwardly into engagement with the overhead structure of the door opening and the tracks 12 are fixed in position as by inserting screws 22 or the like through the central wall and into the overhead structure. Once the tracks have been secured into fixed relation with the overhead structure, the series of spacing members can be removed simply by grabbing the outer wall and pulling down so that each is moved away from the central wall and out of the tracks 12.

As shown in FIG. 1, each movable door mounting assembly 14 includes generally two assemblies; first, a carriage assembly, generally indicated at 50, which is constructed and arranged to be moved horizontally along the track 12 in such a way as to limit the upward movement thereof and, second, a door mounted assembly, generally indicated at 52, which is constructed and arranged to be mounted on an upper edge of the door so as to be moved with the door. These assemblies are constructed and operates in accordance with the teachings of U.S. patent application Ser. No. 09/410,039, filed Oct. 1, 1999, entitled Movable Door Mounting Assembly, which designates as inventors Thomas Pelletier and Gregory Tropea, and is commonly assigned, the disclosure of which is hereby incorporated into the present specification. It will be understood that, while the movable door mounting assembly 14 shown is one which is preferably used in the door installation, any known movable door assembly could be used.

What is claimed is:

1. A system for installing a pair of separate door guiding tracks in a predetermined parallel relation below and to an overhead structure of a door opening comprising applying a series of track spacing members to said pair of separate tracks while said tracks are disposed in said predetermined parallel relation at longitudinally spaced positions along said tracks so as to retain said tracks in said predetermined parallel relation, fixedly securing said tracks while retained in said predetermined parallel relation by said series of spacing members below and to the overhead structure of the door opening and moving each track spacing member downwardly with respect to said pair of tracks after installation to remove the series of track spacing members from said tracks.

2. A system as defined in claim 1 wherein one of said pair of tracks is fixedly secured in its position below and to the overhead structure of the door opening prior to the application of the series of track spacing members to said pair of tracks.

3. A system as defined in claim 1, wherein the track spacing members are applied to the tracks before either track is secured below and to the overhead structure of the door opening.

4. Apparatus for use in installing a pair of elongated tracks in fixedly mounted parallel relation below overhead structure of a door opening, each of said tracks including a central wall constructed and arranged when installed to extend horizontally in fixed relation below the overhead structure of the door opening, a pair of end walls constructed and arranged when installed to extend vertically downwardly from opposite end edges of said central wall, and elongated laterally spaced wheel supporting walls constructed and arranged when installed to extend inwardly toward one another from lower edges of said end walls in vertically spaced relation below said central wall, said apparatus comprising a series of track spacing members constructed and arranged to be removably attached to the pair of tracks in longitudinally spaced relation in operative positions so as to retain the pair of tracks in a predetermined spaced parallel relation with respect to one another during installation, each of said track spacing members including structure constructed and arranged to be engaged between the spaced end walls of the pair of tracks when said spacing member is in said operative position and structure constructed and arranged to be disposed between the end walls of each track in engaged relation between the wheel supporting walls thereof when said spacing member is in said operative position, the structure of each of said track spacing members further being constructed and arranged to enable the track spacing member to be moved into said operative position with respect to the pair of tracks in a direction toward the center walls thereof and to be removed from said operative position with respect to said tracks by a downward movement in a direction away from the central walls thereof after installation.

5. Apparatus as defined in claim 4 wherein each of said track spacing members comprises a molded plastic body including an outer transversely extending portion, a central track end wall engaging portion extending from said outer portion and track entering portions extending from said outer portion in spaced relation on opposite sides of said track end wall engaging portions.

6. Apparatus as defined in claim 5 wherein said central track end wall engaging portions includes opposed surfaces configured and positioned to enter between the tracks and engage adjacent end walls thereof.

7. Apparatus as defined in claim 6 wherein each of said track entering portions includes surfaces constructed and arranged to engage inner edges of the wheel supporting walls of the associated track when said track spacing member is in the operative position thereof.

8. Apparatus as defined in claim 7 wherein said surfaces of each of said track entering portions include slight projections over which the inner edges snap during the movement of the track spacing member into the operative position thereof and which releasably retain the track spacing member in the operative position thereof.

9. Apparatus as defined in claim 8 wherein said track entering portions and said central portion each include a free end section which tapers inwardly toward a free end thereof to facilitate entry within and between the tracks.

10. Apparatus as defined in claim 9 wherein said molded plastic body is formed of peripheral walls of generally uniform thickness integrally interconnected by a central reinforcing wall, said peripheral walls including an outer wall defining said outer transversely extending portion, a pair of generally U-shaped walls defining said track entering portions, each portion having one end connected to an end of said to an outer wall and a central U-shaped wall defining said central portion having opposite ends connected to ends of said pair of U-shaped walls.

11. Apparatus as defined in claim 10 wherein said central reinforcing wall having a periphery integrally interconnected with the central interior surfaces of said peripheral walls except for a pair of oppositely facing generally parallel free edges disposed in closely spaced relation to outer leg portions of said pair of generally U-shaped walls.

12. Apparatus as defined in claim 5 wherein said molded plastic body is formed of peripheral walls of generally uniform thickness integrally interconnected by a central reinforcing wall, said peripheral walls including an outer wall defining said outer transversely extending portion, a pair of generally U-shaped walls defining said track entering portions, each portion having one end connected to an end of said to an outer wall and a central U-shaped wall defining said central portion having opposite ends connected to ends of said pair of U-shaped walls.

13. Apparatus as defined in claim 12 wherein said central reinforcing wall having a periphery integrally interconnected with the central interior surfaces of said peripheral walls except for a pair of oppositely facing generally parallel free edges disposed in closely spaced relation to outer leg portions of said pair of generally U-shaped walls.

14. An overhead door track installation comprising a pair of separate elongated tracks constructed and arranged to be installed in fixedly mounted parallel relation below an overhead structure defining a door opening, each track including a central wall constructed and arranged when installed to extend horizontally in fixed relation below the overhead structure of the door opening, a pair of end walls constructed and arranged when installed to extend vertically downwardly from opposite end edges of said central wall, and elongated laterally spaced wheel supporting walls constructed and arranged when installed to extend inwardly toward one another from lower edges of said end walls in vertically spaced relation below said central wall and a series of longitudinally spaced track spacing members constructed and arranged to be removably attached to said tracks prior to installation so as to retain said pair of tracks in a predetermined spaced parallel relation with respect to one another during the installation and to be removed therefrom with a downward movement after the installation has been completed.

15. An overhead door track installation as defined in claim 14, wherein each said track spacing member is constructed and arranged to be removably attached within each track of said pair of tracks prior to installation and then removed therefrom after installation as aforesaid.

* * * * *